US005309929A

United States Patent [19]

Toll

[11] Patent Number: 5,309,929

[45] Date of Patent: * May 10, 1994

[54] EYELASH MASCARA CASE AND APPLICATOR

[76] Inventor: Charlotte Toll, 312 S. Bedford Dr., Beverly Hills, Calif. 90212

[ * ] Notice: The portion of the term of this patent subsequent to Feb. 23, 2010 has been disclaimed.

[21] Appl. No.: 61,039

[22] Filed: May 14, 1993

Related U.S. Application Data

[63] Continuation-in-part of Ser. No. 808,238, Dec. 16, 1991, Pat. No. 5,188,131.

[51] Int. Cl.[5] ..... A45D 40/26

[52] U.S. Cl. ..... 132/218; 132/320; 401/129; 401/121; 401/122; 401/127

[58] Field of Search ..... 132/218, 320, 216; 401/126, 129, 121, 122, 127

[56] References Cited

U.S. PATENT DOCUMENTS

| | | | |
|---|---|---|---|
| D. 285,125 | 8/1986 | Cassai et al. . | |
| 2,136,771 | 11/1938 | Bednar . | |
| 2,436,291 | 2/1948 | Daniel | 401/122 X |
| 2,675,004 | 4/1954 | Bablon . | |
| 3,764,221 | 10/1973 | Solenghi | 401/129 |
| 4,165,755 | 8/1979 | Cassai | 132/218 |
| 4,428,388 | 1/1984 | Cassai et al. | 132/218 |
| 4,458,701 | 7/1984 | Holland | 132/218 |
| 4,470,425 | 9/1984 | Gueret | 132/218 |
| 5,188,131 | 2/1993 | Toll | 132/218 |
| 5,190,389 | 3/1993 | Vasas | 401/129 X |

FOREIGN PATENT DOCUMENTS

| | | | |
|---|---|---|---|
| 0776191 | 1/1935 | France | 132/218 |

*Primary Examiner*—John G. Weiss
*Assistant Examiner*—Jeffrey A. Smith
*Attorney, Agent, or Firm*—Burns, Doane, Swecker & Mathis

[57] ABSTRACT

An eyelash mascara applicator wand includes a first rod and a bristle-carrying second rod extending transversely relative to the first rod. The rods are joined at a location spaced from both ends of the second rod. Bristles are located on both sides of that junction. The second rod is curved within a plane oriented perpendicular to a plane containing the first rod. The first rod comprises inner and outer sections oriented at a right angle to one another. Alternatively, the first rod could be curved.

25 Claims, 2 Drawing Sheets

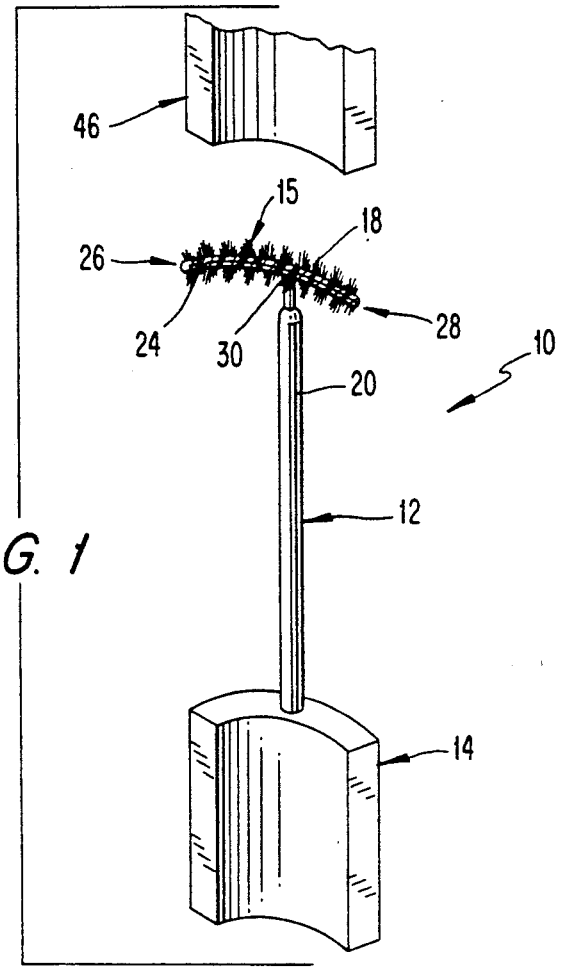
FIG. 1
FIG. 2
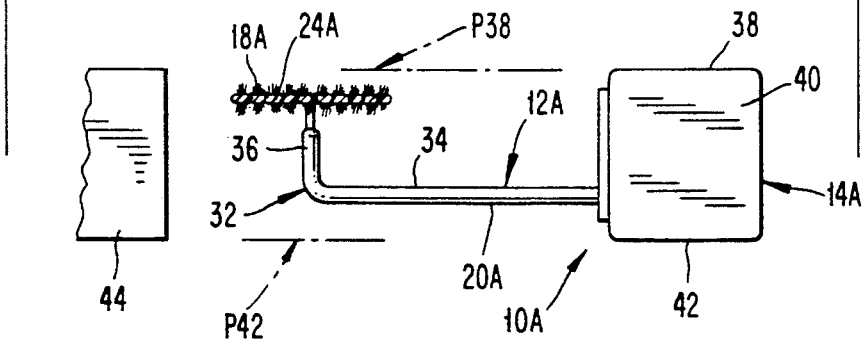
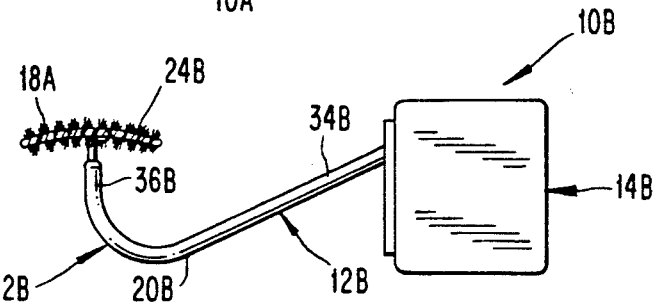
FIG. 3

EYELASH MASCARA CASE AND APPLICATOR

RELATED INVENTIONS

This is a continuation-in-part of Applicant's Ser. No. 07/808,238 filed Dec. 16, 1991, now U.S. Pat. No. 5,188,131 issued Feb. 23, 1993.

BACKGROUND OF THE INVENTION

The present invention relates to an eyelash mascara applicator.

The application of mascara to eyelashes is typically performed by a wand with bristles disposed at one end thereof. The wand is used in conjunction with a cylindrical case or cover in which the mascara is contained in paste form. By inserting the bristle-end of the wand into the case, the bristles pick-up a supply of mascara. The mascara is transferred to the eyelashes by the user who grasps the wand at an end opposite the bristles and moves the bristles against the eyelashes.

One problem which has been encountered during the use of such applicators results from the fact that the end of the wand lies along the axis defined by the handle. Thus, as the handle and wand are moved toward the eye, there is presented a risk that the end of the wand will contact and injure the user's eye.

A mascara applicator purported to deal with that problem is disclosed in U.S. Pat. No. 4,165,755. In that applicator, the bristle end of the wand is mounted for pivotal movement relative to the handle-end, so that the bristle end can be oriented transversely relative to the axis of the handle. However, the bristles will be located on only one side of the wand, making it difficult to apply mascara to the eyelashes located at both ends of the eye, unless the user switches the wand from one hand to the other during the application step.

Also, such an applicator might be difficult to use, if the bristle-end becomes somewhat unstable due to the pivotal feature.

Furthermore, it is necessary to displace the bristle-end to a transverse relationship with the handle-end each time that the wand is removed from the case. This is inconvenient and also presents the possibility that the user's fingers might come in contact with the bristles and become soiled with mascara.

The above-described shortcomings are also characteristic of a mascara applicator disclosed in U.S. Pat. No. 4,428,388 wherein the bristle-end is displaced to a transverse position by bending a non-elastically flexible wand.

SUMMARY OF THE INVENTION

The present invention relates to an eyelash mascara applicator, and also to a combination of the applicator and a mascara-containing case therefor.

The applicator comprises a handle and a wand attached to the handle. The wand includes a first rod portion extending from the handle and a second rod portion extending transversely relative to the first rod portion. Bristles project outwardly around the outer circumference of the second rod portion. The second rod portion includes first and second opposite ends. The first rod portion intersects the second rod portion at a junction spaced from both of the first and second ends, so that bristles are situated on opposite sides of the junction.

Preferably, the second rod portion is curved within a plane oriented substantially perpendicular to a plane containing the first rod portion.

Preferably, the first rod portion includes an inner section extending from the handle, and an outer section joined to the second rod portion, the outer and inner sections being oriented at an angle relative to one another.

A case suitable for use with an applicator according to the present invention has a flexible wiper member therein which includes an elongated passage to receive the brush and wand. The passage comprises (i) an elongated slot having a length sufficient to accommodate travel of the brush, and (ii) a hole through the slot-shape to receive the wand and wipe excess mascara paste therefrom.

The slot and hole are configured in accordance with the shape of the applicator. Thus, the slot could be curved or straight, and the hole could be located centrally of, or at an end of, the slot. There could be two holes located at both ends of the slot.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 1 is a perspective view of a first embodiment of a mascara applicator according to the invention;

FIG. 2 is a side elevational view of a second embodiment of a mascara applicator according to the invention;

FIG. 3 is a side elevational view of a third embodiment of a mascara applicator according to the invention;

DETAILED DESCRIPTION OF PREFERRED EMBODIMENTS OF THE INVENTION

Figure 4:
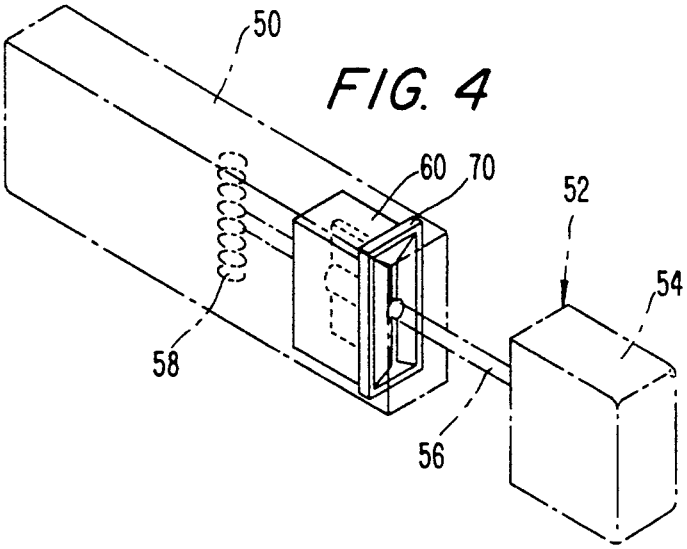
FIG. 4 is a perspective view of a case for use with an applicator in accordance with the present invention.

A mascara applicator 10 comprises a wand 12 and a handle 14. One end of the wand 12 is affixed to the handle 14, and the other end thereof carries a brush 15 having bristles 18. The wand 12 includes a thin first rod 20 fixedly connected to a thin second rod 24 at a junction 30 spaced equal distances from opposite ends 26, 28 of the rod 24. The second rod 24 is curved so as to lie in an imaginary plane oriented perpendicularly to the first rod 20. Thus, the ends 26, 28 of the second rod are spaced equal distances from the handle 14.

The bristles 18 project outwardly around the entire circumference of the rod 24, preferably in a conventional helical pattern along the length of the rod 24. Bristles are located on both sides of the junction 30.

Instead of being helically arranged, the bristles 18 could project radially outwardly from the rod 24 in a random fashion. Either way, however, the bristles will extend completely around the circumference of the rod 24.

The rods 20, 24 are formed of a relatively stiff material and are incapable of appreciable non-elastic deformation.

In use, a user grasps the handle 14 and holds the wand such that the rod 20 is oriented vertically, and the rod 24 is oriented in a horizontal plane so as to be parallel to a row of the user's eyelashes. Thus, the handle 14 would be located below (or above) the eye. The user then transfers mascara from the bristles 18 to the eyelashes by means of a vertical movement of the wand 12.

The curvature of the second rod 24 simulates the curvature of a human eyelid so as to facilitate the application of mascara to the eyelashes.

The holder 14 could be flat or it could be curved, as depicted, so as to correspond to the curvature of the rod 24.

Since bristles 18 are located on opposite sides of the junction 30, it is relatively easy to apply mascara to both ends of the row of eyelashes by a mere twisting of the wrist. If, instead, bristles were located on only one side of the junction 30, it would be necessary for the user to reverse the wand in order to apply mascara to both ends of the eyelash row.

Since the rod 24 is not aligned with the axis of the handle portion, it would be difficult for the user to cause either end of the rod 24 to directly contact the eye. Hence, a safer operation is ensured.

Alternative forms of the applicator are depicted in FIGS. 2 and 3. In a second embodiment of a mascara applicator 10A depicted in FIG. 2, a wand 12A extends from a lower portion of a flat handle 14A. A rod 20A of the wand has a right angle bend 32 such that the rod 20A includes inner and outer sections 34, 36 oriented perpendicularly to one another. A rod 24A of the wand is linear and is joined at its midpoint to the free end of the outer section 36. The entire wand, comprised of the rods 20A, 24A and bristles 18A lies in a plane which is parallel to the plane of the paper and which bisects the handle 14A. Furthermore, the entire wand is situated within a space bordered by the planes of four sides of the handle. Only sides 38, 40, 42 are depicted; the remaining side lies parallel to the side 40. Planes P38 and P42 of two of the sides 38, 42 are depicted. By confining the wand to that space, the wand can be easily inserted into a container or case 44 for the applicator.

The applicator 10A would be used similarly to the earlier-described applicator 10, except that the applicator 10A would be held in a manner more like the way that a user holds a conventional applicator (i.e., an applicator wherein the brush is colinear with a straight wand). That is, the handle 14A would be held to one side of the eye, rather than below (or above) the eye.

A third embodiment of a mascara applicator 10B, depicted in FIG. 3, is generally similar to that described in connection with FIG. 2, with one exception involving the shape of the first rod 20B of the wand 12B. That is, a generally linear inner section 34B of the rod 20B extends downwardly from an upper section of the handle 14B and has a curved juncture 32B with an outer section 36B of the rod 20B.

Another distinction is that the second rod 24B of the wand is curved within the same plane in which the rod section 36B lies, such that a concave side of the second rod faces the first rod. This arrangement is in contrast to the embodiment of FIG. 1 wherein the second rod 24 is curved within a plane oriented perpendicular to the rod 20. The second rod 24B need not be curved, but could be straight. Also, the rod 24A of FIG. 2 could be similarly curved.

Similar to the FIG. 2 embodiment, the wand 12B lies within a space defined by the planes of four sides of the handle 14B. The wand 12B is thus insertable into a case (not shown) shaped identically to the case 44 of FIG. 2. Note that the wand 12 of FIG. 1 could be inserted into a case 46 which is curved in the same manner as the handle 14.

Figure 5:
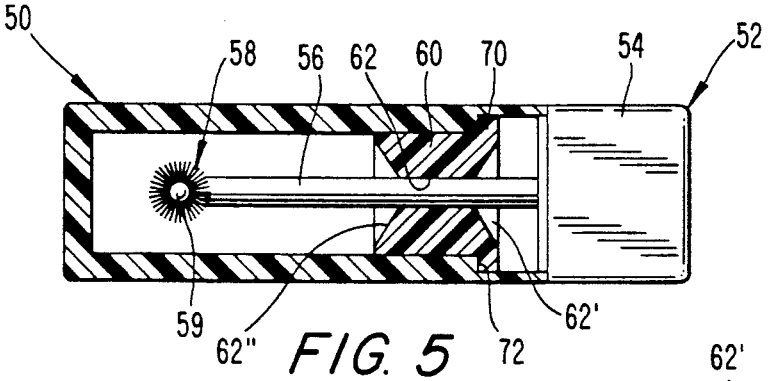
FIG. 5 is a longitudinal sectional view through the case and applicator depicted in FIG. 4.

Depicted in FIGS. 4 and 5 is a case 50 for a mascara applicator 52 of the type disclosed in the aforementioned application Ser. No. 07/808,238 which comprises a handle 54, a wand 56, and a brush 58 disposed at the end of the wand. The brush 58 comprises bristles carried by a linear rod 59 which is intersected intermediate its ends by the wand 52.

The case 50 contains mascara paste at its rear end, and a wiper 60 at its front end. The wiper comprises a body formed of a suitably flexible or elastic material which has a passage 62 extending completely therethrough (see FIG. 6). The passage comprises an elongated slot 64 of a length at least as great as the bristle rod 59, and a cylindrical hole 66 situated centrally of the slot. The cylindrical hole 66 has a diameter slightly smaller than that of the wand 56. It will be appreciated that the brush 58 and wand 56 can be pushed inwardly through the passage 60 to insert the brush into the mascara paste, and then pulled outwardly through the passage 62. During outward travel, the brush and wand will be wiped free of excess mascara paste by the walls of the passage.

The passage 62 is beveled at 62', 62" at its front and rear ends to facilitate entry of the brush into the passage.

Figure 7:
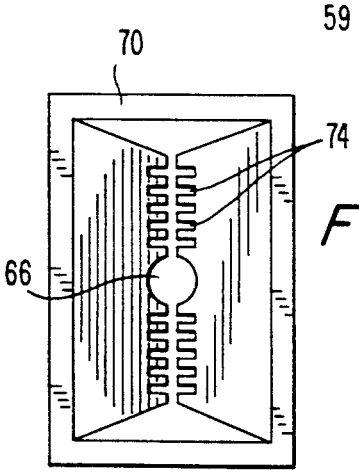
FIG. 7 is an end view of an alternate form of wiper member according to the present invention.
Figure 6:
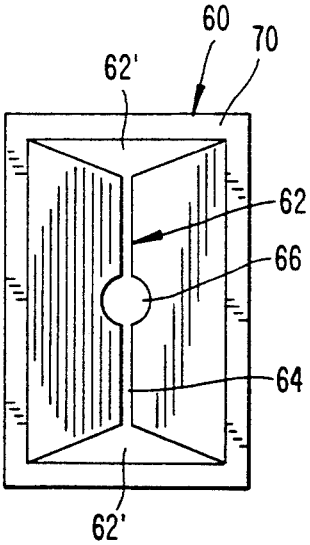
FIG. 6 is an end view of a wiper member used with the case of FIGS. 4 and 5.

The walls of the portion of the passage 62 which engage the brush could be straight as shown in FIG. 6. Alternatively, the walls could have a comb-iike configuration, as depicted in FIG. 7. That configuration is characterized by a series of slots 74 formed in the walls of the passage. The comb-like configuration facilitates travel of the brush through the passage.

The wiper body includes a front flange 70 which bears against a shoulder 72 of the case to prevent inward movement of the wiper body.

Other wipers can be configured to accommodate the applicators depicted in FIGS. 1–3.

Figure 8:
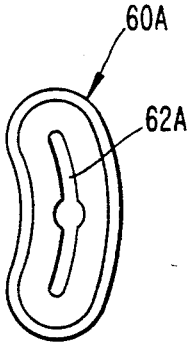
FIG. 8 is an end view of a wiper member suitable for use with the applicator disclosed in connection with FIG. 1.

For example, depicted in FIG. 8 is a wiper 60A for use with the applicator 10 disclosed in connection with FIG. 1. The passage 62A is curved in accordance with the curvature of the brush 15.

Figure 9:
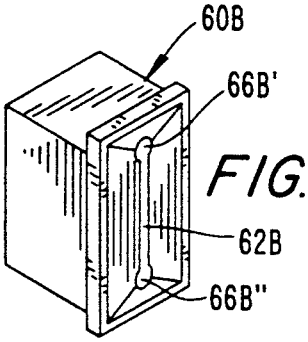
FIG. 9 is a perspective view of a wiper member suitable for use with the applicator disclosed in conjunction with FIG. 2.

A wiper 60B depicted in FIG. 9 could be employed in connection with the applicator 10A disclosed in connection with FIG. 2. That wiper 60B is similar to the wiper 60, except that there are two cylindrical holes 66B', 66B" located at opposite ends of the passage 62B for according travel of the brush 58 and rod section 34, respectively.

Figure 10:
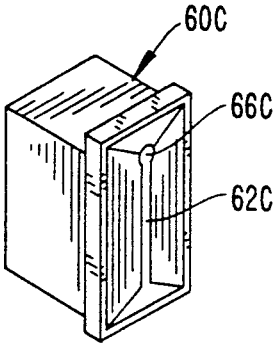
FIG. 10 is a perspective view of a wiper member suitable for use with the applicator disclosed in conjunction with FIG. 3.

The wiper 60C depicted in FIG. 10 could be used in conjunction with the applicator 10B disclosed in connection with FIG. 3. That wiper 60C includes only a single cylindrical hole 66C located at one end of the slot 62C to accord travel of the brush of the applicator 10B.

Although the present invention has been described in connection with preferred embodiments thereof, it will be appreciated by those skilled in the art that additions, modifications, substitutions, and deletions, not specifically described may be made without departing from the spirit and scope of the invention as defined in the appended claims.

What is claimed is:

1. An eyelash mascara applicator comprising a wand and a handle attached to said wand, said wand including a first rod portion extending from said handle, and a second rod portion extending transversely relative to said first rod portion, bristles projecting outwardly around the outer circumference of said second rod portion, said second rod portion including first and second opposite ends, said first rod portion intersecting said second rod portion at a junction spaced from both of said first and second ends, so that bristles are situated on opposite sides of said junction, said second rod portion being curved within a plane oriented substantially perpendicular to a plane containing said first rod portion.

2. An eyelash mascara applicator according to claim 1, wherein said handle is curved similarly to said second rod portion.

3. An eyelash mascara applicator according to claim 1, wherein said first and second rod portions are formed of a stiff material.

4. An eyelash mascara applicator according to claim 1, wherein said junction is located midway between said opposite ends.

5. An eyelash mascara applicator according to claim 1, wherein said bristles are arranged in a helical pattern.

6. In combination, an eyelash mascara case and a mascara applicator insertable therein, said applicator comprising a wand and a handle attached to said wand, said wand including a first rod portion extending from said handle and a second rod portion extending transversely relative to said first rod portion, bristles projecting outwardly around the outer circumference of said second rod portion, said mascara case including a mascara-containing section of oblong cross section shaped to enable said second rod portion to be inserted therein while oriented transversely to said first rod portion, said second rod portion joining said first rod portion at a junction spaced from two opposite ends of said second rod portion so that bristles are situated on opposite sides of said junction, said second rod portion being curved within a plane oriented substantially perpendicular to a plane containing said first rod portion.

7. A combination according to claim 6, wherein said handle and case are curved similarly to said second rod.

8. An eyelash mascara applicator comprising a wand and a handle attached to said wand, said wand including a first rod portion extending from said handle, and a second rod portion extending transversely relative to said first rod portion, bristles projecting outwardly around the outer circumference of said second rod portion, said second rod portion including first and second opposite ends, said first rod portion intersecting said second rod portion at a junction spaced from both of said first and second ends, so that bristles are situated on opposite sides of said junction, said first rod portion including an inner section extending from said handle, and an outer section joined to said second rod portion, said outer and inner sections being oriented at an angle relative to one another.

9. An eyelash mascara applicator according to claim 8, wherein said angle is about ninety degrees.

10. An eyelash mascara applicator according to claim 9, wherein said inner section extends from a lower portion of said handle.

11. An eyelash mascara applicator according to claim 8, wherein said lower section is generally parallel to said second rod portion and said outer section is generally perpendicular to said second rod portion.

12. An eyelash mascara applicator according to claim 8, wherein said inner portion is inclined downwardly from an upper portion of said handle.

13. An eyelash mascara applicator according to claim 12, wherein said inner and outer sections are joined by a curved section of said first rod.

14. An eyelash mascara applicator according to claim 8, wherein said entire wand is situated in a space bordered by the planes of four surfaces of said handle.

15. An eyelash mascara applicator according to claim 8, wherein said second rod portion is straight.

16. An eyelash mascara applicator according to claim 8, wherein said second rod portion is curved within a plane containing said first rod section such that a concave side of said second rod portion faces said first rod portion.

17. A eyelash mascara applicator according to claim 8, wherein said first and second rod portions are formed of a stiff material.

18. An eyelash mascara applicator according to claim 8, wherein said junction is located midway between said opposite ends.

19. An eyelash mascara applicator according to claim 8, wherein said bristles are arranged in a helical pattern.

20. In combination, an eyelash mascara case containing mascara paste, and a mascara applicator insertable therein, said applicator comprising a wand and a handle attached to said wand, said wand including a first rod portion extending from said handle and a second rod portion extending transversely relative to said first rod portion, bristles projecting outwardly around the outer circumference of said second rod portion to define therewith a brush, said mascara case including a flexible wiper having an elongated passage formed therein to receive said brush and wand, said passage comprising an elongated slot having a length sufficient to accommodate travel of said brush, said passage further comprising a hole therethrough shaped for receiving said wand while wiping excess mascara paste therefrom.

21. Apparatus according to claim 20, wherein said brush is curved in a plane lying perpendicular to said wand, said slot being correspondingly curved, said hole being located intermediate the ends of said slot.

22. Apparatus according to claim 20, wherein said first rod portion includes first and second sections oriented substantially perpendicularly to one another, said wiper including a second hole for according travel of said brush.

23. Apparatus according to claim 20, wherein said first rod portion is curved, said hole disposed at one end of said slot.

24. Apparatus according to claim 20, wherein said slot includes opposing walls of comb-like configuration.

25. In combination, an eyelash mascara case containing mascara paste, and a mascara applicator insertable therein, said applicator comprising a wand and a handle attached to said wand, said wand including a first rod portion extending from said handle and a second rod portion extending transversely relative to said first rod portion, bristles projecting outwardly around the outer circumference of said second rod portion to define therewith a brush, said second rod portion joining said first rod portion at a junction spaced from the opposite ends of said second rod portion sot hat bristles are situated on opposite sides of said junction, said mascara case including a flexible wiper having an elongated slot formed therein of a sufficient length for accommodating passage of said brush and wand.

* * * * *